US005694692A

United States Patent [19]

Reinschreiber

[11] Patent Number: 5,694,692

[45] Date of Patent: Dec. 9, 1997

[54] INJECTION MOLDED BOLSTER SCALE ASSEMBLIES FOR A KNIFE

[75] Inventor: M. Robert Reinschreiber, Aurora, Ohio

[73] Assignee: American Consumer Products, Inc., Solon, Ohio

[21] Appl. No.: 514,558

[22] Filed: Aug. 14, 1995

[51] Int. Cl.[6] ..... B26B 1/02

[52] U.S. Cl. ..... 30/155; 30/164; 76/104.1

[58] Field of Search ..... 30/151, 155–164; 29/451, 527.3, 525.06; 76/104.1

[56] References Cited

U.S. PATENT DOCUMENTS

| | | | |
|---|---|---|---|
| 1,802,990 | 4/1931 | Vossler | 30/164 |
| 1,862,649 | 6/1932 | Amoroso | 30/155 |
| 2,252,896 | 8/1941 | Mounts | 30/164 |
| 2,581,062 | 1/1952 | Allen | 30/164 |
| 2,977,678 | 4/1961 | Swinden | 30/155 |
| 5,129,771 | 7/1992 | Briles | 29/525.06 |

FOREIGN PATENT DOCUMENTS

| | | | |
|---|---|---|---|
| 579618 | 8/1946 | United Kingdom | 30/164 |

*Primary Examiner*—Hwei-Siu Payer

[57] ABSTRACT

A knife is prepared by the process comprising the steps of injection molding a plastic bolster scale unit having a side bolster portion; attaching the bolster scale unit to a knife frame; and attaching a handle cover to the bolster scale unit adjacent to the side bolster portion; whereby the transition from side bolster portion to handle cover exhibits precise dimensions with sharp angles and close fitting parts.

14 Claims, 4 Drawing Sheets

INJECTION MOLDED BOLSTER SCALE ASSEMBLIES FOR A KNIFE

BACKGROUND OF THE INVENTION

The present invention relates to a cost saving method for manufacturing a knife, or more specifically, a method for simulating a machined or cast metal appearance of a bolster scale assembly on a knife handle.

A conventional, high quality lock-back folding knife assembly 75 is shown in FIG. 2 of the drawings. The assembly comprises a knife skeleton 74, a double bolster scale assembly 70 having side bolsters 73, and a handle cover 72. The bolster scale assemblies 70 for these types of high quality knives are usually constructed of a separate liner 76 to which the bolsters 73 are pinned and or welded; or the bolster unit 70 may be machined from solid metal pieces such as nickel, silver, brass or stainless steel.

The machining or casting processes produces sharp, clean edges especially at the transition edges 71 of the bolster scale assemblies. When all of the knife pieces are assembled, the transition from the side bolsters 73 to the handle cover 72 is precise and clean with substantially no gaps in between the side bolsters and the handle cover, giving the knife 75 the appearance of crisp dimensions with sharp angles and close-fitting parts. However, the machining, casting, tooling and assembly processes used to produce these bolster scale assemblies 70 are expensive and time-consuming, which correspondingly increases the costs of manufacturing the folding-knives 75.

A conventional knife, shown in FIG. 1 of the drawings, includes a single bolster scale assembly constructed from the relatively inexpensive manufacturing process of stamping the single bolster scale units 60 from sheet metal. However, it is widely known that the metal stamping process cannot allow for the sharp edges produced by the machining or metal casting processes described above. Therefore, the transition edges 61 forming the handle cover receiving area 67 are curved and have large radii.

When the knife 66 is assembled using the stamped bolster scale unit 60, the transition from the side bolsters 65 to the handle cover 62, because of the rounded corners 61 and the slanted transition surfaces 68, is not precise and leaves substantially large gaps between the side bolsters 65 and the handle cover 62. Furthermore, after stamping the bolster scale units 60, the bolster scale units 60 must be trimmed of excess metal or flash and then polished to remove the scratches and tooling marks caused during the stamping process. Therefore, even though the metal stamping process reduces the cost of manufacturing the knife 66, the rounded edges 61 of the bolster scale unit and the irregularities of the outer surfaces of the stamped bolster scale unit exhibits a lower quality knife assembly 66 as compared to the knife 75, of FIG. 2, assembled with the machined or metal cast bolster scale assemblies 70.

SUMMARY OF THE INVENTION

In accordance with the present invention, a bolster scale unit is made by injection molding plastic material to produce a bolster scale unit with the look of hand-finished, machined or precision cast (sintered) metal.

In a first embodiment of the invention, a knife is prepared by the process of injection molding a plastic bolster scale unit having a side bolster, attaching the bolster scale unit to the knife frame, and attaching a handle cover to the knife frame between the side bolster levels of the bolster scale unit. The transition of the side bolster to the handle cover leaves substantially no gaps and the knife handle thus exhibits precise dimensions with sharp angles and close-fitting parts, simulating an expensive knife-handle assembled using a machined or precision cast bolster scale unit.

A method for simulating a machined or cast metal appearance of a bolster scale unit on a knife includes the steps of injection molding a plastic bolster scale unit having a side bolster portion with a side bolster inner surface and a side bolster outer surface, a side bolster transition surface substantially normal to the side bolster outer and inner surfaces, and a sharp, substantially 90° corner at an intersection of the transition surface and the side bolster outer surface; metal plating the bolster scale unit; and attaching a handle cover into a handle cover receiving portion of the bolster scale unit, creating a precise fit substantially without gaps therebetween; whereby the transition of the side bolster outer surface to the handle cover outer surface exhibits precise dimensions with sharp angles and close-fitting parts, simulating a knife-handle having a machined or metal cast bolster scale assembly that has been machine- and hand-polished.

Accordingly, it is an object of the present invention to provide an inexpensive bolster scale assembly, which simulates an expensive, machined or metal cast bolster assembly. It is a further object of the present invention to provide an inexpensive and efficient process of producing such a bolster scale assembly.

Other objects and advantages will be apparent from the following description, the accompanying drawings and the appended claims.

DETAILED DESCRIPTION

Figure 1:
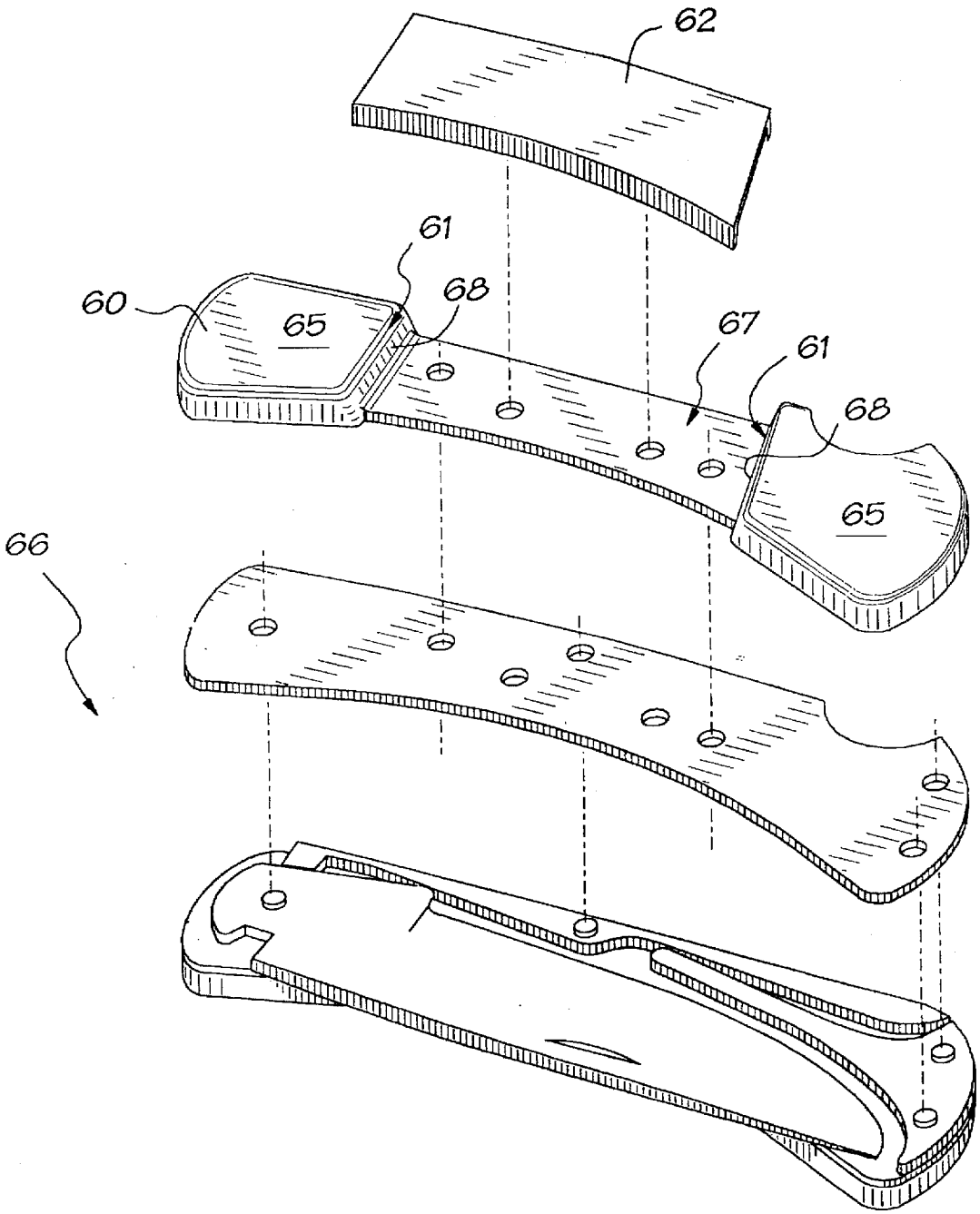
FIG. 1 PRIOR ART
FIG. 1 shows a prior-art knife assembly having a stamped metal side bolster scale unit.
Figure 2:
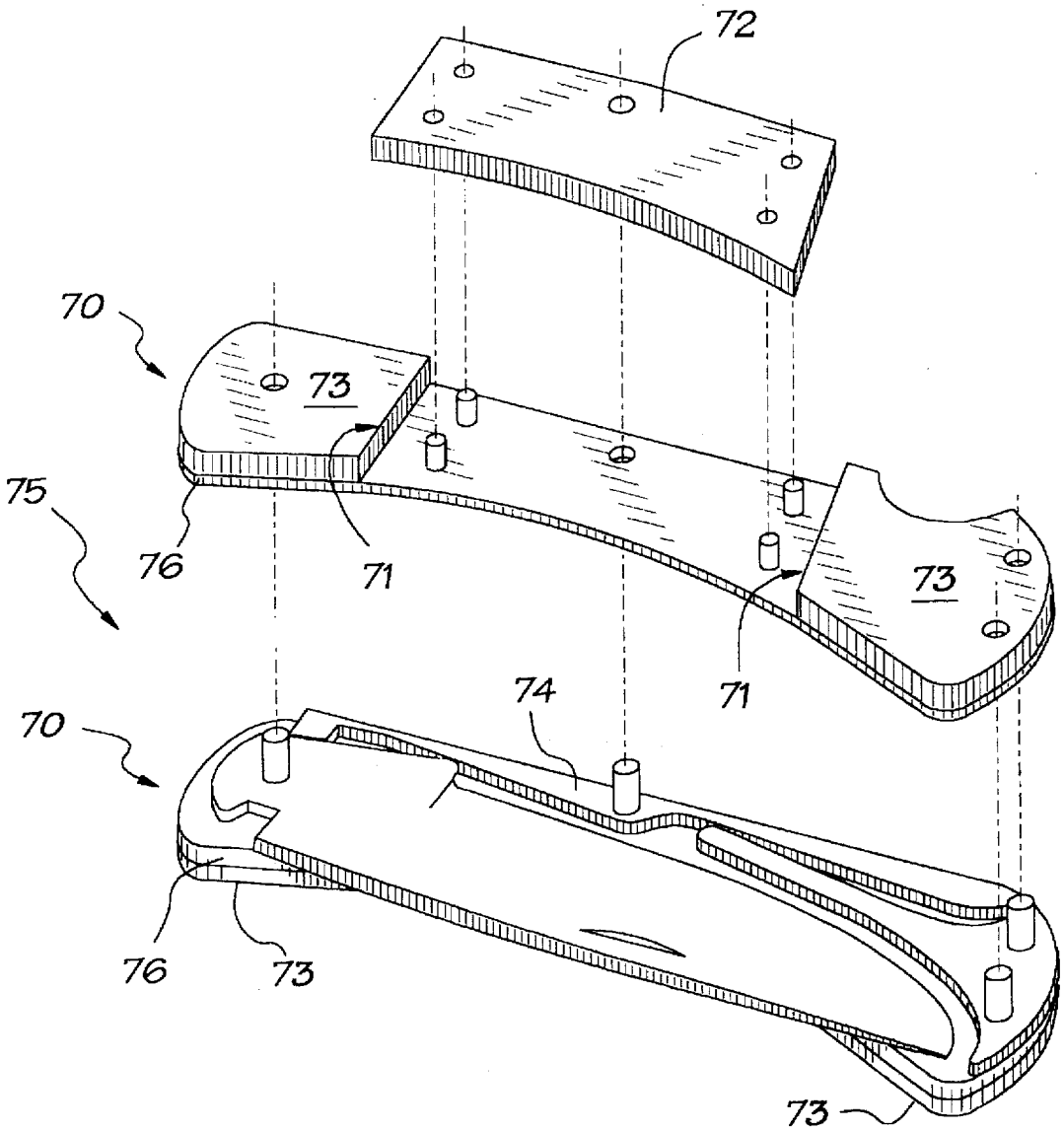
FIG. 2 PRIOR ART
FIG. 2 shows a prior-art knife assembly having a machined or precision cast side bolster scale assembly.
Figure 3:
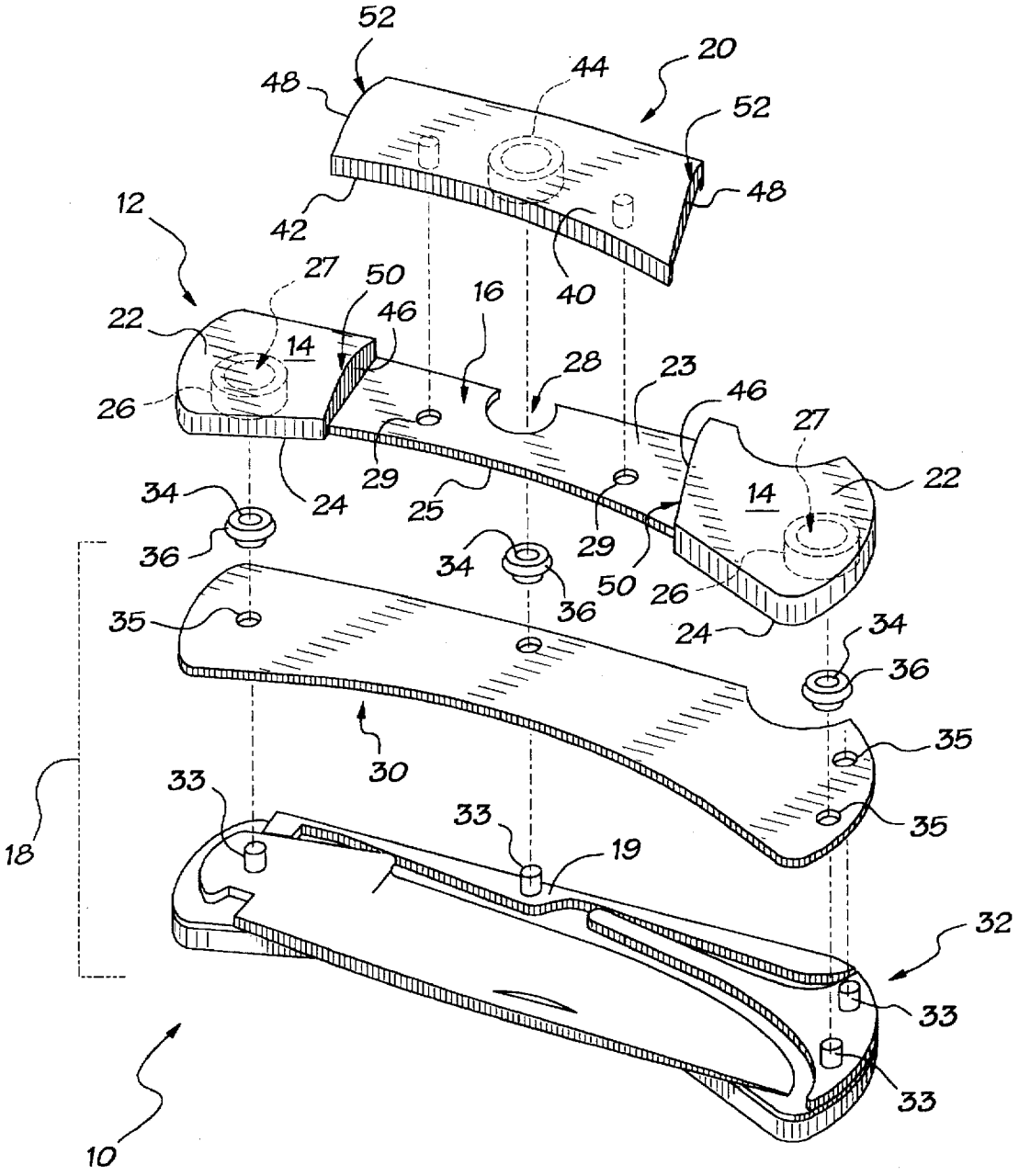
FIG. 3 shows a first embodiment of the invention, which is a knife assembly having an injection molded plastic side bolster scale unit.

As shown in FIG. 3, a first embodiment of knife 10 is prepared by injection molding a platable plastic bolster scale unit 12 having double side bolsters 14 and a handle cover receiving liner portion 16. Each side bolster 14 has an outer surface 22, an inner surface 24, and raised bosses 26 on the inner surface 24. The liner portion 16 has an outer surface 23 and an inner surface 25, with a spring pin receiving hole 28 and at least two handle cover receiving holes 29 extending through it. The plastic bolster scale unit also has transition surfaces 46 substantially normal to the outer and inner surfaces 22 & 24 of the side bolsters 14, where sharp substantially ninety degree corners 50 are formed at the intersections of the side bolster outer surfaces 22 and the transition surfaces 46. The transition surfaces 46 also form substantially ninety degree corners with the outer surface 23 of the liner portion 16.

The injection molded plastic bolster scale unit 12 is preferably molded from platable plastic. After injection molding, the bolster scale unit 12 can be metal plated to simulate the appearance of machined or metal cast, hand-finished metal.

To assemble the knife 10, a side metal plate 30 is attached to a flat surface 19 of a knife skeleton or lock lever unit 32, thus forming a knife-frame 18. The side metal plate 30 is attached by receiving pins 33 through holes 35 in the plate and locking retainer nibs or rivets 34 having flared portions 36 over the pins. It is also within the scope of the invention to have a knife-frame 18 comprising a knife skeleton 32 having flared studs (not shown) in place of the metal plate 30, pins 33 and flared rivets 34.

The raised bosses 26 have cavities 27 used for press-fitting the bolster scale unit 12 with the knife-frame 18. The cavities 27 in the raised bosses 26 have an inner-diameter which is slightly smaller than the diameter of the flared portion 36 of the rivets 34 such that the bolster scale unit 12 can be friction fit to the knife-frame 18. The plastic bolster scale unit 12 is attached to the knife frame 18 over the metal plate 30 by press-fitting the raised bosses 26 over the flared rivet heads 34. At least one of the rivets 34 will extend through the spring pin receiving hole 28 in the liner portion 16 such that a handle cover 20 having a similar raised boss 44 may also be friction fit to the knife-frame 18.

The handle cover 20 is preferably injection molded plastic. It is also within the scope of the invention to form the handle cover from other suitable materials such as wood or bone. The handle cover 20 has an inner surface 42, an outer surface 40, transition surfaces 48 substantially normal to the outer and inner surfaces 40 & 42, and sharp substantially ninety degree corners 52 at the intersections of the outer surface 40 and the transition surfaces 48.

The handle cover 20 is attached to the knife frame 18 over the liner portion 16 of the bolster scale unit 12 by friction fitting the handle cover's raised boss 44 over the flared rivet 34 exposed through the spring pin receiving hole 28 of the bolster scale unit 12.

When assembled, the transition from the side bolsters 14 to the handle cover 20 leaves substantially no gaps in-between and thus the knife handle exhibits the precise dimensions, sharp angles and close fitting parts of the more expensive knives assembled with hand-finished, machined-metal or metal cast bolster scale assemblies. Furthermore, the knives assembled with the injection molded bolster scale assemblies require fewer processing steps than the knives assembled with the stamped metal bolster scale assemblies; which may allow the injection molded knives to be even less expensive than the metal stamped knives.

In an alternative to the first embodiment discussed above, the knife 10 may have two substantially flat sides 19 and the assembly comprising the metal plate 30, the injection molded plastic bolster scale unit 12, and the handle cover 20 may be attached identically to both sides of the knife 10. Furthermore, it will be apparent to one skilled in the art that the invention will not only apply to folding-knives as depicted in the Figures but will apply to any knife handle assembly using similar bolster scale assemblies.

Figure 4:
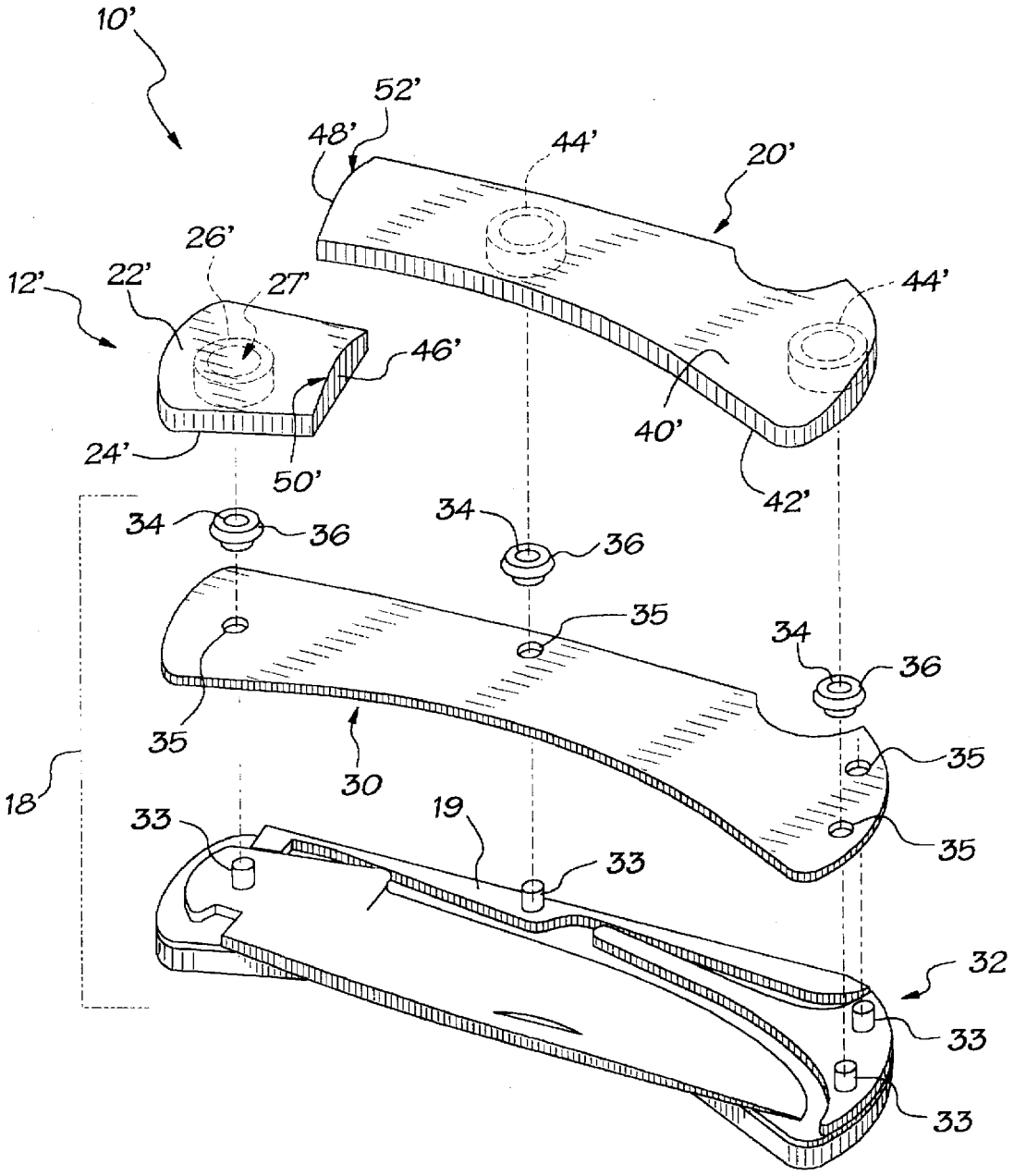
FIG. 4 shows a second embodiment of the invention, which is a knife assembly having a single plastic injection molded bolster scale unit.

As shown in FIG. 4, a second embodiment of folding knife 10' is prepared by injection molding a plastic bolster unit 12' having an outer surface 22' an inner surface 24' and a transition surface 46' substantially normal to the outer and inner surfaces 22' & 24', where a sharp substantially 90° corner 50' is formed at the intersection of the outer surface 22' and the transition surface 46'.

The injection molded plastic bolster unit 12' is preferably molded from platable plastic. After injection molding, the bolster unit 12' can be metal plated to simulate the appearance of machined, hand-finished metal.

To assemble the knife 10' a side metal plate 30 is attached to a flat surface 19 of a folding knife skeleton, thus forming a knife frame 18. The side metal plate 30 is attached by receiving pins 33 through holes 35 in the plate and locking retainer nibs or rivets 34 having flared portions 36 over the pins.

The inner surface 24' of the plastic bolster unit 12' has a raised boss 26' used for press fitting the bolster unit 12' with the knife frame 18. The raised boss 26' has a cavity 27' that has an inner-diameter which is slightly smaller than the diameter of the flared portions 36 of the rivets 34 such that the bolster unit 12' can be friction fit to the knife frame 18. The plastic bolster unit 12' is attached to the folding knife skeleton 32 over the metal plate 30 by press fitting the raised boss 26' over the flared rivet head 34, forming a single bolster scale assembly.

A handle cover 20' having an inner surface 42', an outer surface 40', a transition surface 48' substantially normal to the outer and inner surfaces 40' & 42', where a sharp substantially 90° corner 52' is formed at the intersection of the outer and transition surfaces 40' & 48'.

The handle cover 20' has raised bosses 44' and the handle cover is attached to the folding knife frame 18 by friction fitting the handle cover's raised bosses 44' over the flared rivets 34.

When assembled, the transition from the bolster scale unit 12' to the handle cover 20' leaves substantially no gaps in between and thus the knife handle exhibits the precise dimensions, sharp angles and close fitting parts of the more expensive knives assembled with hand finished, metal cast and machined-metal bolster scale assembles.

In an alternative to the second embodiment discussed above, the folding knife 10' may also have two substantially flat sides 19; and the assembly comprising the metal plate 30, the injection molded plastic bolster unit 12', and the handle cover 20' may be attached identically to both sides of the folding knife 10'.

Having described the invention in detail and by reference to the drawings, it will be apparent that modifications and variations are possible without departing from the scope of the invention as defined in the following claims.

What is claimed is:

1. A knife having a substantially flat handle surface comprising:

a knife frame having a substantially flat surface;

a plastic bolster scale unit having a side bolster portion with a side bolster inner surface and a side bolster outer surface, and a bolster portion transition surface substantially normal to said side bolster inner and said side bolster outer surfaces, wherein said side bolster inner surface of said plastic bolster scale unit is attached to said flat surface of said knife frame; and a handle cover, having an outer surface, an inner surface and a transition surface substantially normal to said outer and said inner surfaces of said handle cover, wherein said inner surface of said handle cover is attached to said flat surface of said knife frame, and wherein said transition surface of said handle cover abuts said bolster portion transition surface of said plastic bolster scale unit substantially without gaps therebetween;

said plastic bolster scale unit is created by an injection molding process; and at least said side bolster outer surface of said plastic bolster scale unit is covered with a metal plating;

whereby the transition of said side bolster portion to said handle cover exhibits precise dimensions with sharp angles and close fitting parts.

2. The knife of claim 1, wherein a second plastic bolster and a second handle cover is attached on a second substantially flat surface of said knife frame.

3. The knife of claim 2, wherein the knife is a folding-knife.

4. A knife prepared by a process comprising the steps of:

injection molding a plastic bolster scale unit having a side bolster portion;

attaching said bolster scale unit to a knife frame;

attaching a handle cover to said bolster scale unit adjacent to said side bolster portion; and after injection molding said bolster scale unit and before attaching said bolster scale unit to said knife frame, applying a metal-plating to said bolster scale unit;

wherein substantially no gap exists between said plastic bolster scale unit and said handle cover; and whereby the transition from said side bolster portion to said handle cover exhibits precise dimensions with sharp angles and close fitting parts.

5. The knife of claim 1, wherein said process further comprises the step of, before attaching said handle cover to said bolster scale unit:

plastic injection molding said handle cover.

6. The knife prepared of claim 5, wherein the knife has two substantially flat sides and all of said process steps are performed for both sides of the knife.

7. The knife of claim 1, wherein the knife has two substantially flat sides and all of said process steps are preformed for both sides of the knife.

8. A folding-knife prepared by a process comprising the steps of:

injection molding a plastic bolster scale unit having a side bolster with a side bolster outer surface and a side bolster inner surface, and having raised hollow bosses on said side bolster inner surface;

attaching a side metal plate to a folding-knife skeleton using rivets having flared heads;

attaching said bolster scale unit to said side metal plate by interference fitting at least one of said raised hollow bosses on said side bolster inner surface of said bolster scale unit over at least a first of said flared rivet heads; and attaching a handle cover, having an outer surface, an inner surface and a hollow raised boss on said inner surface of said handle cover, to said side metal plate adjacent to said side bolster of said bolster scale unit by interference fitting said raised hollow boss on said inner surface of said handle cover over at least a second of said rivet heads, such that there is substantially no gap between said handle cover and said side bolster;

whereby the transition from said side bolster to said handle cover on the folding-knife exhibits crisp dimensions with sharp angles and close fitting parts.

9. The folding-knife of claim 8, wherein said process further comprises the step of, after step injection molding said bolster scale unit and before attaching said bolster scale unit to said side metal plate:

applying a metal-plating to said bolster scale unit.

10. The folding-knife of claim 9, wherein said process further comprises the step of, before attaching said handle cover to said side metal plate:

plastic injection molding said handle cover.

11. The folding-knife of claim 10, wherein the folding-knife has two substantially flat sides and all of said process steps are performed for both sides of the folding-knife.

12. The folding-knife of claim 8, wherein the folding-knife has two substantially flat sides and all of said process steps are performed for both sides of the folding-knife.

13. The folding-knife of claim 12, wherein said bolster scale unit has a cover receiving portion having a hole extending through, wherein said second of said rivet heads protrudes through said hole upon attaching said bolster scale unit to said side metal plate.

14. A method for simulating a machined or cast metal appearance of a bolster scale assembly on a knife comprising the steps of:

injection molding a plastic bolster scale unit having a side bolster portion with a side bolster inner surface, and a side bolster outer surface, a transition surface substantially normal to said side bolster outer surface and said inner surfaces, and a sharp substantially ninety degree corner at an intersection of said transition surface and said side bolster outer surface;

covering at least said side bolster outer surface with a metal plating;

attaching said side bolster inner surface to a substantially flat side surface of a knife frame;

attaching a handle cover to said substantially flat side surface of said knife frame, wherein said handle cover has an inner surface, an outer surface, a transition surface substantially normal to said outer and said inner surfaces of said handle cover, and a sharp substantially ninety degree corner at an intersection of said handle cover transition surface and said handle cover outer surface, such that said transition surface of said handle cover abuts said transition surface of said bolster scale unit substantially without gaps therebetween;

whereby the transition from said side bolster portion to said handle cover exhibits precise dimensions with sharp angles consistent with close-fitting machined parts.

* * * * *